US009931805B2

(12) United States Patent
Toro

(10) Patent No.: US 9,931,805 B2
(45) Date of Patent: Apr. 3, 2018

(54) PROCESS FOR REALISING BLANKS FOR BOXES TO MEASURE

(75) Inventor: Andrea Toro, Fiorano Modenese (IT)

(73) Assignee: SYSTEM S.P.A., Fiorano Modenese (IT)

( * ) Notice: Subject to any disclaimer, the term of this patent is extended or adjusted under 35 U.S.C. 154(b) by 628 days.

(21) Appl. No.: 13/876,812

(22) PCT Filed: Oct. 18, 2011

(86) PCT No.: PCT/IB2011/054618
§ 371 (c)(1),
(2), (4) Date: Mar. 28, 2013

(87) PCT Pub. No.: WO2012/063152
PCT Pub. Date: May 18, 2012

(65) Prior Publication Data

US 2013/0225383 A1 Aug. 29, 2013

(30) Foreign Application Priority Data

Nov. 11, 2010 (IT) ..... MO2010A0324

(51) Int. Cl.
*B31B 1/14* (2006.01)
*B31B 17/00* (2006.01)
(Continued)

(52) U.S. Cl.
CPC ..... *B31B 17/00* (2013.01); *B31B 50/00* (2017.08); *B31B 50/006* (2017.08); *B31B 2105/0025* (2017.08)

(58) Field of Classification Search
CPC ..... B31B 17/00; B31B 1/74; B31B 2201/95; B31B 2217/086; B31B 2217/084; B31B 2219/145; B31B 2219/147
(Continued)

(56) References Cited

U.S. PATENT DOCUMENTS 4,262,582 A * 4/1981 Sugimoto ..... G05B 19/195 493/128
4,283,188 A * 8/1981 Wingerter ..... B31B 11/00 493/120
(Continued)

FOREIGN PATENT DOCUMENTS

JP 02-121834 A1 5/1990
JP 07241941 A 9/1995
(Continued)

*Primary Examiner* — Sameh Tawfik
(74) *Attorney, Agent, or Firm* — Pearne & Gordon LLP

(57) ABSTRACT

A process for realizing blanks for the manufacture of boxes to measure, characterized in that it includes the following stages: —collecting at least a sheet of packing material from at least a store; —transferring it to a cutting station in which the sheet itself is cut so that a plurality of pieces is obtained therefrom, which plurality of pieces exhibits a common dimension and other dimensions which are different from one another according to predetermined ratios; —collecting the pieces, according to the dimensions of the box to be formed, in order to cut them into the predetermined dimensions, after joining, when necessary, one or more of said dimensionally homogeneous pieces so as to form a piece that is longer than the one available and suitable for constituting the "bottom" piece, which includes the bottom and at least two first opposite lateral walls of the box to be formed; cutting to measure said pieces and subjecting them singly to a first and a second marking in order to obtain weakened or folding lines in predetermined positions; —and after removal, if necessary, of corner portions of some pieces, carrying out the composition thereof in order to form a single body constituting the blank, flat, complete and ready to be folded and glued to form the box.

8 Claims, 2 Drawing Sheets

(51) Int. Cl.
*B31B 50/00* (2017.01)
*B31B 105/00* (2017.01)

(58) Field of Classification Search
USPC ..... 493/56
See application file for complete search history.

(56) References Cited

U.S. PATENT DOCUMENTS 4,398,901 A * 8/1983 Campbell ..... B31B 11/00
493/167
4,604,083 A * 8/1986 Barny ..... B31B 1/74
493/28
4,627,223 A 12/1986 Janhonen
5,097,651 A * 3/1992 Decottignies ..... B65D 75/008
493/110
5,772,569 A * 6/1998 Janhonen ..... B65D 75/38
493/128
5,807,223 A * 9/1998 Holton ..... B31B 1/28
493/120
7,381,176 B2 * 6/2008 Graham ..... B31B 1/90
493/123
8,323,165 B2 * 12/2012 Atoui ..... B31B 17/00
493/175

FOREIGN PATENT DOCUMENTS

JP H07241941 A 9/1995
JP 2000202926 A 7/2000
JP 2002172713 A 6/2002

* cited by examiner

PROCESS FOR REALISING BLANKS FOR BOXES TO MEASURE

TECHNICAL FIELD

The present invention relates to a process for realising blanks for manufacturing boxes to measure.

The present invention also relates to a plant for manufacturing boxes to measure.

The application of the invention extends to all those cases in which it is necessary to package objects into boxes usually having a parallelepiped shape and prevalently made of cardboard, but also of other materials suited to the purpose.

Prior Art

According to the prior art, for packaging products of varying nature and above all of different dimensions, it is necessary to have at one's disposal boxes, for example of the "American" type, of various sizes in order to be able to use the most suitably sized box for each unit to be packaged. Obviously, where there exists a large variety in the dimensions of the products to be packaged in boxes, it is necessary to have at one's disposal an adequate variety of boxes in which to insert the various products.

The necessity of having a large variety of boxes available is a source of not inconsiderable problems at the packaging stage because it entails setting up adequate storage facilities for the boxes as well as making the choice of the right box at the time of packaging.

Precisely the need to limit the number of boxes of different sizes to be used for packaging makes it necessary, whenever the "right" box is not available, to employ boxes of larger size than what is strictly required for the packaging of many products and to fill spaces that remain empty with filler material so that the products do not have freedom of movement inside the boxes concerned and are thus not subject to possible damage.

This also implies higher packaging costs compared to the ideal solution of being able to employ a "made-to-measure" box, i.e. one that is exactly dimensioned so as to contain "to measure" the product.

Another increase in the costs of packages realised in the above-described manner is determined by the cost for the larger quantity of filler-cushioning material as well as the higher transport costs mainly ascribable to the greater volume occupied by the package and, in part, the greater weight.

In addition to the problems just described, what is implied by the fact of having a certain quantity of boxes available in order to meet the variety of demands should be kept clearly in mind.

The problem also arises in cases where the formation of a box takes place on the spot, that is, shortly before packaging, in a specific forming machine starting from a flat or die-cut blank, often of cardboard, which consists of a flat, shaped form provided with predetermined fold lines and is specifically designed to be formed so as to give rise to a box.

Obviously, corresponding to different types and/or sizes of boxes there are an equal number of different blanks, which require not only the setting up of dedicated stores but also an accurate management thereof depending on the packaging needs of the various products.

The principal object of the present invention is to obviate the above-listed limitations and drawbacks of the prior art by means of a process for forming boxes "to measure", i.e. capable of forming a box, which must be employed for packaging a specific individual product, and is dimensionally made to measure for that specific individual product starting from an initial semiprocessed blank, used as the unprocessed material, which, at least in terms of morphological and dimensional characteristics, is equal to the one used for the packaging "to measure" of all the other boxes which differ from one another in size (also in one dimension only).

One advantage of the invention is represented by the very substantial reduction of waste compared to the prior art.

Another advantage may surely also be found "upstream", i.e. in the production of the sheets, for example of cardboard, from which the blank must then be obtained. In fact, according to the invention, such production is simplified and limitable to a single size standard for the unprocessed material, or rather the initial semiprocessed blank (sheet) for the formation of boxes of different sizes.

DESCRIPTION OF THE INVENTION

Further characteristics and advantages of the present invention will become better apparent from the following detailed description of an embodiment of the present invention, illustrated by way of non-limiting example in the appended figures, in which.

Figure 1:
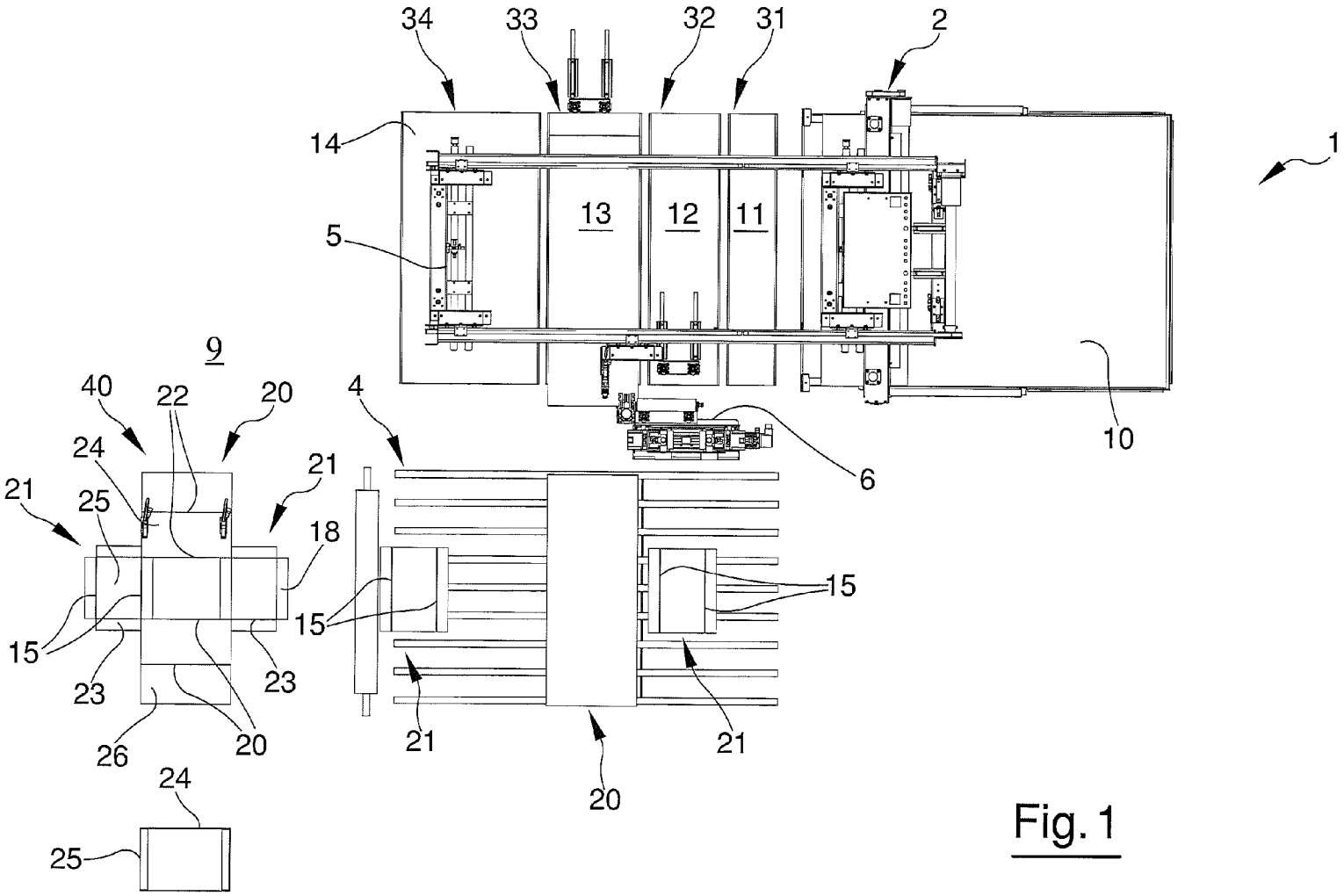
FIG. 1 is a plan view from above of the features of a plant according to the invention.
Figure 2:
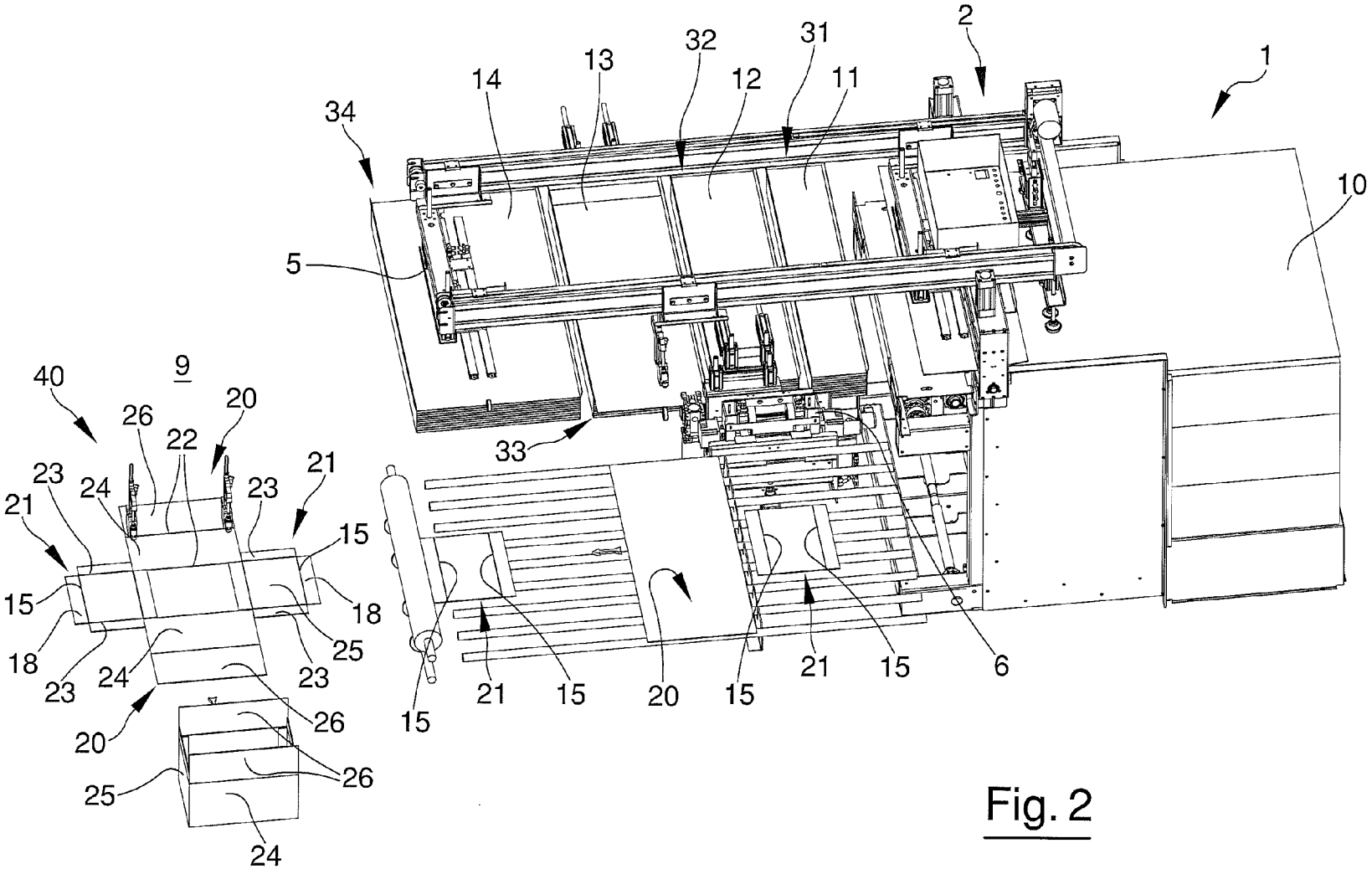
FIG. 2 is a perspective view of the plant shown in FIG. 1.

In the above-mentioned figures a plant is schematically represented in which a process for realising boxes to measure is implemented, said process comprising the following stages:

- collecting at least a sheet 10 of packing material from at least a store 1 of unprocessed material 1 constituted by sheets 10 of packing material having predetermined dimensions and arranged to form a stack;
- transferring the sheet 10 collected from the store 1 to a cutting station 2 in which the sheet 10 itself is cut in such a way as to obtain therefrom a plurality of pieces 11, 12, 13, 14, which exhibit a common dimension and other dimensions which differ from one another according to predetermined ratios;
- transferring the pieces 11, 12, 13, 14 on command to at least a plurality of stores 31, 32, 33, 34 consecutively aligned to one another, each of which is predisposed to house dimensionally homogeneous pieces in stacks;
- collecting, on command, from one of the stores 31, 32, 33, 34 which is preselected according to one of the dimensions of the box to be formed, single pieces 20 for forming the bottom of the box and at least two first opposite lateral walls 24 thereof;
- collecting, on command, from one of the stores 31, 32, 33, 34 which is preselected according to another of the dimensions of the box to be formed, single pieces 21 for forming two second opposite lateral walls 25 of the box;
- joining, when necessary, one or more dimensionally homogeneous pieces one after another so as to form, in each box forming cycle, at least one piece that is longer than the dimensionally homogeneous pieces housed in a corresponding store 31, 32, 33, 34, where said longer piece is realised, when necessary, at least when destined to constitute the "bottom" piece 20, which comprises the bottom and at least two first opposite lateral walls 24 of the box being formed;
- cutting to measure the "bottom" piece 20;

cutting to measure other lateral pieces 21, dimensionally homogeneous to one another and destined to form the two second opposite lateral walls 25;

transferring the bottom and lateral pieces 20, 21 onto a work plane 4 located alongside the plurality of stores 31, 32, 33, 34;

a first marking or scoring, singly applied, either on the lateral pieces 21 or on the bottom piece 20 in order to realise, in predetermined positions of each piece, weakened or scored lines 15 (for a subsequent folding thereof) parallel to the direction of motion in which the pieces are transferred to the work plane 4, where the work plane 4 is motorised so as also to realise, on command, a motion of transport of the bottom and lateral pieces 20, 21 in a direction perpendicular to the direction of motion in which the pieces 11, 12, 13, 14 are transported from the stores 31, 32, 33, 34 to the work plane 4;

a second marking or scoring, for realising either on the bottom piece 20 and/or on the lateral pieces 21, in predetermined positions, weakened or scored lines 22 or 23, which are perpendicular to the direction of motion of transfer from the stores 31, 32, 33, 34 to the work plane 4;

removing, if necessary, corner portions of some of the bottom and/or lateral pieces 20, 21 previously cut to measure;

a composition serving to join the bottom and lateral pieces 20, 21, previously cut to measure, in order to form a single body constituting the blank 40, which is flat, complete and ready to be folded and glued to form the box.

The first marking or scoring is applied singularly, or on lateral pieces 21 or on the bottom piece 20 in order to realise, in predetermined positions of each piece, weakened or scored lines 15 which enable, with subsequent folding, the definition of flaps that are used to allow the walls of the box to be joined by gluing.

The single pieces 20 for forming the bottom of the box and at least two first opposite lateral sides 24 thereof can also comprise one or more walls 26 having a cover function, which, once composition of the box has been completed with the bottom wall and the lateral walls 24 and 25, are folded so as to form the cover and are fixed onto flaps 18, appropriately folded on the weakened or scored lines of the lateral walls 21.

The sheets 10 of packing material having predetermined dimensions and arranged to form a stack are identical to one another at least with reference to the greater dimensions thereof: length and width.

The joining of one or more of the dimensionally homogeneous pieces one consecutively to another, as a continuous strip, is achieved by joining the pieces at the ends of smaller dimension thereof.

The joining of the pieces at the ends is achieved by partially overlapping and reciprocally fixing the ends themselves.

Preferably, the joining is achieved by partially overlapping and then gluing the overlapping parts (flaps).

The process described can be implemented by means of a plant comprising at least a store 1 of unprocessed material, or rather semiprocessed material which is constituted by sheets 10 of packing material having predetermined dimensions and being arranged to form a stack.

Known means are provided for picking up the sheets 10 from the store 1 and transferring them to a cutting station 2, in which the sheets 10 are cut so that a plurality of pieces 11, 12, 13, 14 is fashioned from each sheet, said pieces having one dimension in common and other dimensions which differ according to predetermined ratios.

The pieces 11, 12, 13, 14 are transferred into a plurality of stores 31, 32, 33, 34, each of which is intended to house the dimensionally homogeneous pieces 11, 12, 13, 14 arranged in stacks.

The stores 31, 32, 33, 34 are aligned consecutively to one another and are served by a transport device 5 capable of depositing, on command, the various pieces 11, 12, 13, 14 in the respective stores 31, 32, 33, 34. Thus, each store is specifically dedicated so as to accommodate only one type of piece (i.e. all the pieces which have the same identical dimensions).

A work unit 6 collects single pieces 11, 12, 13, 14, on command, from each of the stores 31, 32, 33, 34 and, again on command, at least for some pieces, proceeds to join several dimensionally homogeneous pieces consecutively to one another so as to form pieces that are longer than the dimensionally homogeneous pieces housed in the corresponding store 31, 32, 33, 34 and to transfer the pieces onto a work plane 4 located alongside the stores 31, 32, 33, 34.

The work plane 4 is provided with a transport motion, which takes place on command in a direction perpendicular to the motion of the work unit 6, i.e. in a direction perpendicular to the direction of motion in which the pieces 11, 12, 13, 14 are transferred from said stores 31, 32, 33, 34 to said work plane 4.

A cutter is associated with the work unit 6 and serves to cut the pieces to measure. Cutting is performed on command selectively on the single piece that will then go to make up the blank for forming the box.

A first device associated with said cutter is suitable for applying a first marking or scoring, on at least some of the pieces, in order to realise, in predetermined positions on each piece, weakened or scored lines (for subsequent folding) parallel to the direction of motion in which the pieces are transferred to the work plane 4.

A second device suitable for applying a second marking or scoring, in order to realise, in predetermined positions on each piece, weakened or scored lines perpendicular to the direction of motion of transfer from the stores 31, 32, 33, 34 to the work plane 4, is located "downstream" of the area of the plane 4 on which the pieces are deposited.

A device for performing, if required, a removal of corner portions from some of the pieces previously cut to measure is provided "downstream" of the second device.

Finally, there is provided a station 9 for performing the composition serving to join the pieces previously cut to measure marked with weakened or scored lines in order to form a single body constituting the blank 40, which is flat, complete and ready to be folded and glued to form the box.

In particular, the cutter is designed to perform, for the forming of each box, both the cutting to measure of a "bottom" piece 20, which comprises the bottom and at least two first opposite lateral walls 24 of a box 40 being formed, and the cutting to measure of further lateral pieces 21, dimensionally homogeneous to one another and destined to form two second opposite lateral walls 25.

In particular, the single pieces 20 for forming the bottom of the box and of at least two first opposite lateral walls 24 thereof can also comprise one or more walls 26 having a cover function, which, once the composition of the box has been completed with the bottom wall and the lateral walls 24 and 25 are folded to form the cover and are fixed onto flaps 18, appropriately folded on the weakened lines 15 of the lateral walls 21.

In the plant layout illustrated, the first device applies a first marking or scoring on the lateral pieces 21 in order to realise, in predetermined positions of each piece, weakened or scored lines (for subsequent folding) parallel to the direction of motion in which the pieces are transferred to the work plane 4. The lines 15 are realised on the lateral pieces 21, whereas the lines 22 are realised on the bottom piece 20.

The second device applies a second marking or scoring on the lateral pieces 21 in order to realise, in predetermined positions on the lateral pieces 21, weakened or scored lines 15 on the lateral pieces 21 perpendicular to the direction of motion of transfer from said stores 31, 32, 33, 34 to said work plane 4.

There is also envisaged the possibility that weakened or scored lines for enabling the folding of flaps are realised only on the bottom piece 20.

The supply of packing material by means of identical panels requires the use of a type of storage unit that allows significant cost savings. There is also envisaged the use of a second store with respective part 5, 31, 32, 33, 34, 6 to speed up execution and dispose the groove of the cardboard in the desired direction.

An analogous type of savings is achieved by the manufacturer of the initial semiprocessed product (sheets), who has the possibility of simplifying and standardising his production to a very considerable degree.

The invention claimed is:

1. A process for realising boxes to measure, characterised in that it comprises the following steps:

collecting a sheet (10) of packing material from a store (1) of unprocessed material constituted by sheets (10) of packing material having predetermined dimensions and arranged to form a stack;

transferring the sheet (10) collected from the store (1) to a cutting station (2) and cutting the sheet (1) into a plurality of pieces (11, 12, 13, 14), which plurality of pieces (11, 12, 13, 14) exhibit (a) a common longitudinal dimension and (b) lateral dimensions which are different from one another according to predetermined ratios wherein the longitudinal dimension is length, and wherein the lateral dimensions are widths;

transferring the pieces (11, 12, 13, 14) on command to at least a plurality of stores (31, 32, 33, 34), each of which is predisposed to house dimensionally homogeneous pieces in stacks;

collecting, on command, from one of the stores (31, 32, 33, 34) which is preselected according to one of the dimensions of a box to be formed, single pieces for forming a bottom of a box and two first opposite lateral walls (24) thereof;

collecting, on command, from one of the stores (31, 32, 33, 34) which is preselected according to another of the dimensions of a box to be formed, two second opposite lateral walls (25) thereof;

joining, if necessary, two or more dimensionally-homogeneous pieces one after another to form a longer piece with respect to the dimensionally-homogeneous pieces housed in a corresponding store (31, 32, 33, 34), the longer piece being adapted to constitute a bottom piece (20) which comprises the bottom and at least two first opposite lateral walls (24) of the box being formed;

cutting to measure said bottom piece (20);

cutting to measure other lateral pieces (21), dimensionally homogeneous to one another and destined to form the two second opposite lateral walls (25);

transferring the bottom and lateral pieces (20, 21) on a work plane (4);

a first marking or scoring, singly operated, either on the lateral pieces (21) or on the single bottom piece (20) for realising, at predetermined positions of each piece, first weakened or scored lines parallel to each other;

a second marking or scoring, for realising either on the bottom piece (20) and/or on the lateral pieces (21) in predetermined positions, second weakened or scored lines which are perpendicular to the first weakened or scored lines;

optionally removing corner portions of some of the bottom and/or lateral pieces (20, 21) previously cut to measure; and joining the bottom and lateral pieces (20, 21), previously cut to measure, to form a single body constituting the blank (40), flat, complete and ready to be folded and glued to form the box.

2. The process of claim 1, characterised in that the single pieces (20) for forming the bottom of the box and at least two first opposite lateral sides (24) thereof, also comprise one or more walls (26) to form a cover of the box and adapted to be fixed on flaps (18), appropriately folded on the weakened or scored lines of the lateral walls (21).

3. The process of claim 2, characterised in that the sheets (10) of packing material having predetermined dimensions and arranged to form a stack are identical to one another at least with reference to length and width.

4. The process of claim 2, comprising the joining of the two or more dimensionally-homogeneous pieces one after another and thereby forming a continuous strip, the joining being done at ends of smaller dimensions of the two or more pieces.

5. The process of claim 1, characterised in that the sheets (10) of packing material having predetermined dimensions and arranged to form a stack are identical to one another at least with reference to length and width.

6. The process of claim 1, comprising the joining of the two or more dimensionally-homogeneous pieces one after another and thereby forming a continuous strip, the joining being done at ends of smaller dimensions of the two or more pieces.

7. The process of claim 6, characterised in that the joining of the pieces at the ends thereof is done by partially superposing and reciprocally fixing the ends.

8. The process of claim 7, characterised in that the joining of the pieces at the ends thereof is done by partial superposing and relative gluing of the superposed parts.

* * * * *